United States Patent [19]

Swaidner et al.

[11] 4,362,676

[45] Dec. 7, 1982

[54] SEAL FOR HEATED ENCLOSURE

[75] Inventors: James A. Swaidner; Wendell C. Holzhauer, both of Bowling Green, Ohio

[73] Assignee: Manville Service Corporation, Denver, Colo.

[21] Appl. No.: 245,862

[22] Filed: Mar. 20, 1981

[51] Int. Cl.[3] ..... F27D 1/18

[52] U.S. Cl. ..... 264/35; 264/265; 264/319

[58] Field of Search ..... 264/35, 31, 136, 265, 264/319

[56] References Cited

U.S. PATENT DOCUMENTS

| | | | |
|---|---|---|---|
| 3,872,195 | 3/1975 | Stegmeier | 264/35 |
| 3,877,675 | 4/1975 | Shapland | 264/333 |
| 3,917,771 | 11/1975 | Basile | 264/35 |
| 4,010,231 | 3/1977 | Phillips | 264/35 |
| 4,086,309 | 4/1978 | Alberts | 264/35 |

*Primary Examiner*—John A. Parrish
*Attorney, Agent, or Firm*—Ronald M. Halvorsen; Richard K. Thomson

[57] ABSTRACT

This invention relates to the sealing of heated enclosures wherein the enclosure is provided with an opening (16) allowing access to the interior of the enclosure. A means for heating the enclosure and a means for closing (22) the access opening (16) are also provided. A compliant sealing material (26) disposed about the periphery of the access opening (16) is between the enclosure (10) and the closing means (22). A thermosetting material is intermixed with the sealing material (26) such that when the heating means heats the enclosure (10) the thermosetting material allows the sealing material (26) to be permanently molded to the shape of the closing means (18). A method of sealing a heatable enclosure (10) having an access opening (16) and a door (18) closing the enclosure (10) is also provided.

3 Claims, 3 Drawing Figures

SEAL FOR HEATED ENCLOSURE

TECHNICAL FIELD

This invention relates to seals and more particularly relates to an improved seal for a heated enclosure.

BACKGROUND OF THE PRIOR ART

Sealing doors for process ovens are of a nature that compression gaskets are not used since the latching mechanisms for the sealing doors cannot be of a nature to impose a large compressive force to the sealing means. Historically the seals for such doors have been a simple fold of a heat resistant material or what has become known as a tadpole tape because of its shape. Difficulties in obtaining a good seal with the above sealing means have been experienced; one reason being that the sealings means have uniform and standard diameters while the gap between the door and the frame of such process ovens because of the sheet metal construction is non-uniform.

BRIEF SUMMARY OF THE INVENTION

An object of the present invention is to provide a new and improved seal.

Another object of the instant invention is to provide an effective moldable seal for a heated enclosure which is inexpensive and simple to install.

A further object of the invention is to provide a custom molded seal for each oven door.

The present invention provides a seal for a heated enclosure comprising an enclosure having an opening allowing access to the interior of the enclosure, means for heating the enclosure and means for closing the access opening. A compliant sealing material is disposed about the periphery of the access opening and is juxtaposed between the enclosure and the closing means. A thermosetting material is intermixed with the sealing material whereby when the thermosetting material is heated the sealing material may be permanently molded to the shape of the closing means.

The present invention also provides a method of sealing a heatable enclosure having an access opening and a door for closing the enclosure comprising disposing a compliant sealing material about the periphery of the access opening and intermixing a curable thermosetting material with the sealing material. The door is forced against the sealing material and the thermosetting material is then cured whereby the sealing material conforms to the shape of the door.

DETAILED DESCRIPTION OF THE INVENTION

Figure 1:
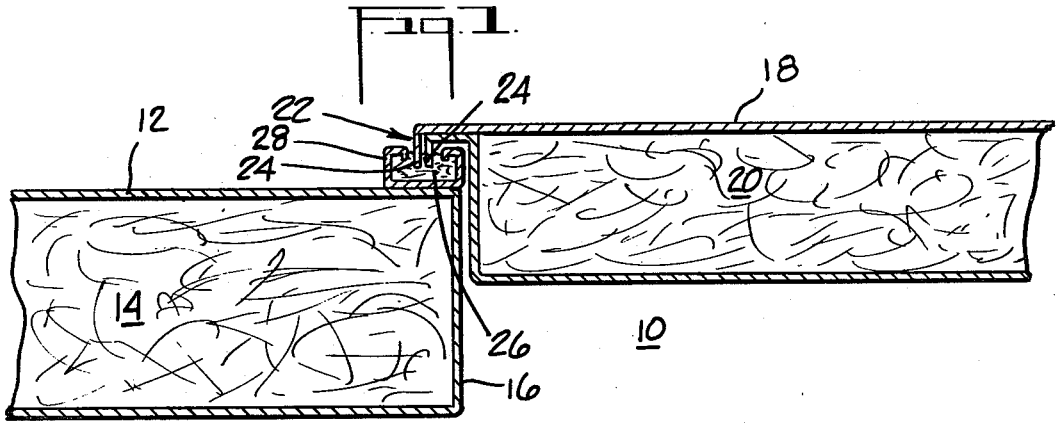
FIG. 1 is a partial cross-sectional view of a heated enclosure provided with the seal of the present invention.

Like characters are used throughout the following description and the accompanying drawings to designate corresponding parts. Referring first to FIG. 1 there is partially shown a heated enclosure 10 of a type such as a drying oven briefly described in U.S. Pat. No. 4,112,174 issued Sept. 5, 1978 to Hannes et al which comprises a plurality of walls 12 (a portion of same are shown) having insulation 14 disposed therein. An access opening 16 of the enclosure 10 is provided in order to allow access into the interior of the enclosure 10 for any purpose, for example, maintenance or repair. A means (not shown) heats up the interior of the enclosure 10.

A door 18 which is provided with insulation 20 is affixed to an exterior wall 12 of the enclosure 10 by some means (not shown) in order to allow or prevent access to the interior of the enclosure 10. The door, of course, if properly sealed, would effectively prevent the escape of heat and/or heated gases from the interior of the enclosure 10. The door 18 is provided with a peripheral edge 22 which when the door 18 is closed comes into close proximity to the exterior surface of the wall 12 of the enclosure 10. The peripheral edge 22 is shown in FIG. 1 as comprising, in this example, an irregular and arbitrary shape composed of two sheet metal plates 24.

In order to seal off the access opening 16 from the environment surrounding the heated enclosure 10 a resilient, moldable or a compliant sealing material 26 is juxtaposed between the peripheral edge 22 of the door 18 and the exterior surface of the wall 12. The material 26 may be a fibrous insulating material made out of mineral wool such as refractory or glass materials and is provided with a thermosetting material intermixed therewith for a purpose which will be understood later. Any suitable fibrous material may be used but it has been found useful to utilize a material known in the trade as CERAFIBER which is sold by Johns-Manville Corporation.

The soft resilient fibrous sealing material 26 may be contained within a frame 28 which is disposed proximate the access opening 16. The frame 28 is substantially U-shaped and provides a means to protect the sealing material 26 from physical or mechanical damage when the door is opened for various purposes.

Intermixed with the sealing material is an uncured but curable binder for a purpose which will be understood shortly. By uncured but curable it is meant that no intentional processing step has been performed wherein curing, partially or fully has been accomplished to any substantial degree and which is ascertainable by well-known tests.

During installation the sealing material 26 is installed in the retaining U-shaped channel 28 with the uncured binder applied to it. A release agent is applied to the mating peripheral edge 22 of the door 18. A suitable release agent is silicone oil and may be sprayed on the edge of the door 18. The door 18 is then closed and opened to check for a 100% seating of the seal, i.e., a 100% fit between the peripheral edge 22 and the sealing material 26. The door is then closed and heat is applied to the sealing material 26 in order to cure the binder. The binder material can be any suitable thermosetting binder material such as, for example, phenolic resin. The binder preferably is added to the material 26 in an amount of about 8%. The heating may be supplied to the sealing material 26 by means of an independent heating source such as a torch applied directly to the material 26 and/or may be the heat which is supplied to the enclosure 10 during operation of the enclosure 10.

Figure 2:
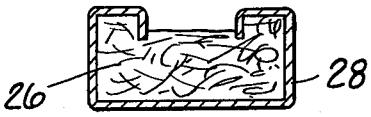
FIG. 2 is a view of the sealing material prior to heating of the thermosetting material and before the door of the enclosure is forced against the sealing material.
Figure 3:
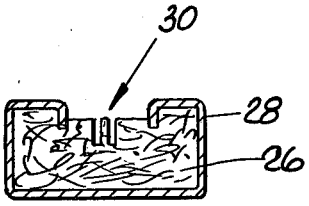
FIG. 3 is a view of the sealing material after the thermosetting material has adapted to the shape of the door and is cured.

As is shown in FIG. 2, the sealing material 26 is undeformed prior to the curing of the binder and before the door is pressed against the material 26. After heating of the sealing material 26 and its binder material the thermosetting binder causes the fibrous sealing material 26 to conform exactly to the physical configuration of the peripheral edge 22 of the door 18 as is shown by the shape 30 depicted in FIG. 3.

The result is a cured, molded in place seal that has allowed for all of the individual dimensional variations between a door 18 and the exterior surface of the oven face 12 that the seal is installed on. Because a door 18 can now have a custom molded seal that fits without dimensional compromise the net result is a uniform and near perfect seal. As a final result, fumes and heat are retained within the oven enclosure 10 because of the 100% contact of the sealing material. The seal of the present invention has been used up to a process temperature of 600° F. The ultimate process temperature at which the seal of the present invention may be used is dependent upon oven construction, since CERAFIBER material is stable to 2300° F.

It is to be understood that all the details in the foregoing description of the invention need not be strictly adhered to and that various changes and modifications may suggest themselves to one skilled in the art, all falling within the scope of the invention as defined by the sub-joined claims.

What is claimed and desired to be secured by Letters Patent of the United States is:

1. A method of providing a seal between a planar surface surrounding an access opening of a heated enclosure and a non-planar peripheral edge of a door which closes said access opening and is subject to repeated openings and closings, comprising:

securing a resilient fibrous insulating material about the periphery of said access opening to said planar surface;

intermixing an uncured, but curable, thermosetting material with said fibrous insulating material;

forcing the non-planar peripheral edge of said door into contact with said fibrous insulating material causing the latter to adopt a configuration compatible with the former;

subjecting said fibrous insulating material and intermixed thermosetting material to sufficient heat to cure said thermosetting material, such that said fibrous insulating material permanently adopts said configuration which is compatible with the non-planar peripheral edge of the door so that a seal is formed between said planar surface and said non-planar peripheral edge of the door each time said door is closed, following said repeated openings.

2. The method of claim 1 wherein said fibrous insulating material and intermixed thermosetting material are subjected to heat by heating said enclosure.

3. The method of claim 1 further comprising applying a release agent to said non-planar peripheral edge prior to curing said thermosetting material.

* * * * *